US007631995B1

(12) United States Patent
Pedersen

(10) Patent No.: US 7,631,995 B1
(45) Date of Patent: Dec. 15, 2009

(54) OVERHEAD LIGHT SWIVEL BRACKET ASSEMBLY

(76) Inventor: Charles E. Pedersen, 1380 SW. 57 St., Plantation, FL (US) 33317

( * ) Notice: Subject to any disclaimer, the term of this patent is extended or adjusted under 35 U.S.C. 154(b) by 26 days.

(21) Appl. No.: 12/072,184

(22) Filed: Feb. 25, 2008

(51) Int. Cl.
*F21S 8/00* (2006.01)

(52) U.S. Cl. ..... 362/427; 362/431

(58) Field of Classification Search ..... 362/427, 362/431

See application file for complete search history.

(56) References Cited

U.S. PATENT DOCUMENTS 2,746,187 A * 5/1956 Ennever ..... 40/624
4,372,071 A 2/1983 Vicino
4,954,935 A 9/1990 Hammond
5,517,393 A * 5/1996 Townsend et al. ..... 362/233
5,818,640 A 10/1998 Watanabe
5,934,795 A 8/1999 Rykowski
2003/0137840 A1 7/2003 Citron
2004/0090785 A1 5/2004 McInnis

* cited by examiner

*Primary Examiner*—Sandra L O'Shea
*Assistant Examiner*—Meghan K Dunwiddie
(74) *Attorney, Agent, or Firm*—Alvin S. Blum

(57) ABSTRACT

An overhead light swivel bracket assembly mounts a light fixture spaced apart a fixed distance and position from a surface to be illuminated such as a billboard. A long bracket has a distal end for the light fixture, and a vertical capped sleeve at the proximal end for rotation on a fixed vertical cylinder, enabling the light fixture to rotate pivotally about the vertical cylinder in a horizontal arc between an extended position in which the light fixture is at the fixed distance and position to illuminate the surface from above and a retracted position in which the light fixture is adjacent a worker positioned behind the surface for servicing by the worker.

8 Claims, 5 Drawing Sheets

OVERHEAD LIGHT SWIVEL BRACKET ASSEMBLY

FIELD OF THE INVENTION

This invention relates generally to apparatus for mounting and maintaining light sources above illuminated billboards, traffic displays, buildings, and the like.

BACKGROUND OF THE INVENTION

Outdoor displays such as, but not limited to, billboards, building signs, and traffic displays, are often provided with electric lights. The light fixtures require very specific positions for optimal function. In is becoming more popular to illuminate from above rather than below to avoid light pollution. These lights are generally high intensity light assemblies that may weigh about sixty pounds. Billboards with overhead lights are generally provided with a walkway, catwalk, or the like behind the display that is easily accessible. However, the lights are mounted many feet away from the surface being illuminated, too far to reach from the catwalk. When a bulb burns out, on average of once every 18 months, it may be hard to reach it for replacement. The worker may have to resort to a ladder or a "cherry picker" crane to safely replace the bulb or make other repair. The maintenance costs involved with conventional light assemblies are consequently very high, and may be dangerous. U.S. Pat. No. 5,517,393 issued May 14, 1996 to Townsend discloses a rotatable conveyor assembly to move the lights to one side for maintenance of lights over a roadway. Applicant has filed co-pending utility patent application Ser. No. 11/500,803 for another illumination assembly.

SUMMARY OF THE INVENTION

It is accordingly an object of the invention to provide a light source holder for illuminating a display from above that is simple, convenient and safe to install and maintain with correct positioning as specified by the manufacturer. It is another object that the assembly be inexpensive to construct for retrofitting existing displays as well as in construction of original equipment. It is yet another object that the assembly not introduce complexity that may further add maintenance costs. It is yet another object that the invention provide safe and easy access to the light source without expensive apparatus.

The swivel bracket assembly of the invention includes an elongate bracket with the light fixture at one end and the other end pivotally mounted on a vertical cylinder. The bracket may be locked in place in the extended position with the fixture above the display to be illuminated. It may be locked in a retracted position with the fixture accessible to a worker behind the display.

These and other objects, features, and advantages of the invention will become more apparent when the detailed description is studied in conjunction with the drawings, in which like elements are designated by like reference characters in the various drawing figures.

DETAILED DESCRIPTION

Figure 1:
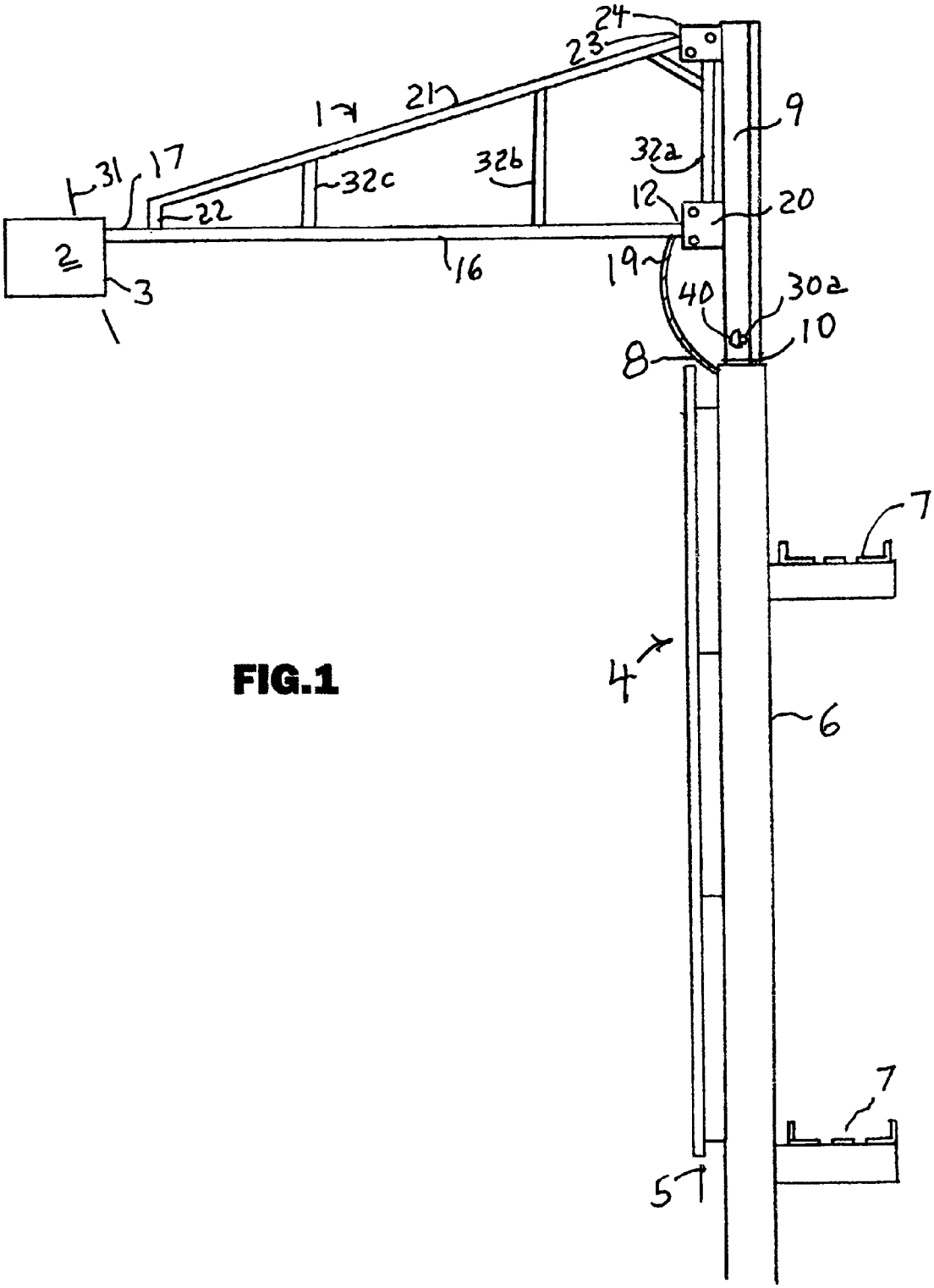
FIG. 1 is a side elevation view of a billboard with assembly of the invention in extended position.
Figure 2:
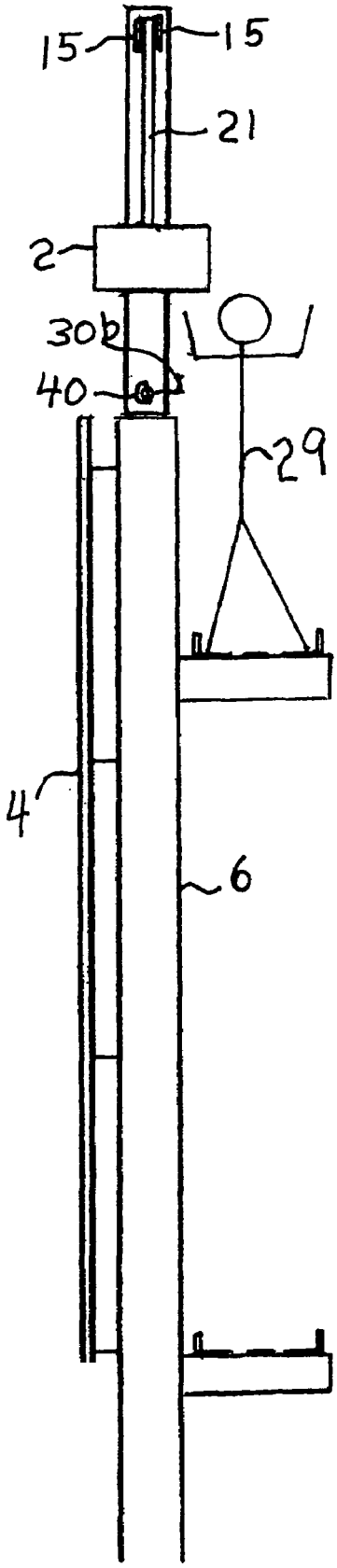
FIG. 2 is a side elevation view of the billboard with assembly in retracted position.
Figure 3:
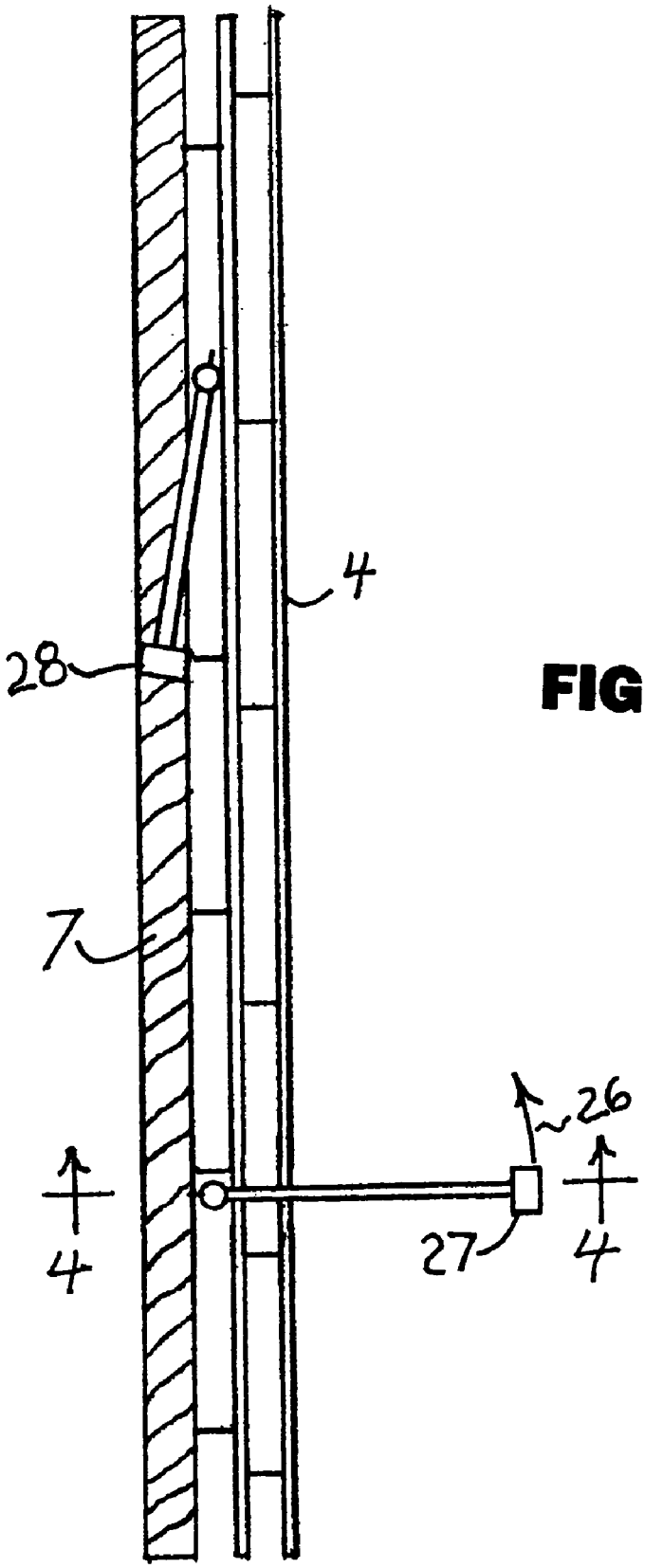
FIG. 3 is a top view of the billboard with one assembly in extended position and another in retracted position.

Referring now first to FIGS. 1-4, an overhead light swivel bracket assembly 1 of the invention is mounted on a rigid support structure such as the billboard structure 6 shown that has catwalks, or walkways 7 for worker access. The structure 6 supports a display surface 4 lying in a vertical plane 5 to be illuminated by light fixture 2 that shines light from a fixed distance and overhead position 3 as prescribed by the manufacturer. The assembly comprises an elongate vertical cylinder 9 having a lower end 10 affixed to the structure 6, and an upper end 13 that serves as a rotational support for a sleeve 14 with a top cap 11 that is dimensioned to be rotatably supported on the upper end of the cylinder. Grease between the two enhances operation. An elongate tubular member 16 has a distal end 17 for affixing the light fixture thereto, and an internal passage 18 for electric wire 19 for connecting the light fixture to the electric power conductor 8. A proximal end 12 of member 16 is attached by first attaching means 20 to the sleeve 14. An elongate element 21 has a first end 22 affixed to the distal end of member 16 adjacent the light fixture and a second end 23 attached by second attaching means 24 to the sleeve above the first attaching means. At least one stiffening strut 32*a*, 32*b*, 32*c* connect the tubular member to the elongate element depending on the load requirements.

The capped sleeve, elongate tubular member, elongate element, and strut combine to form a secure supporting bracket for the light fixture. It has rotational function to enable the light fixture to rotate pivotally about the vertical cylinder in a horizontal arc 26 between an extended position 27 to illuminate the display and a retracted position 28 for access by a worker 29 for maintenance. Apertures 30*a* and 30*b* pass through the diameters of the sleeve and the cylinder to provide for a locking pin 40 (shown partially cut away to reveal the aperture). This enables the worker to releasably lock the fixture in the extended position for use and the retracted position for maintenance or in storms, etc. while standing behind the plane of the display.

Figure 4:
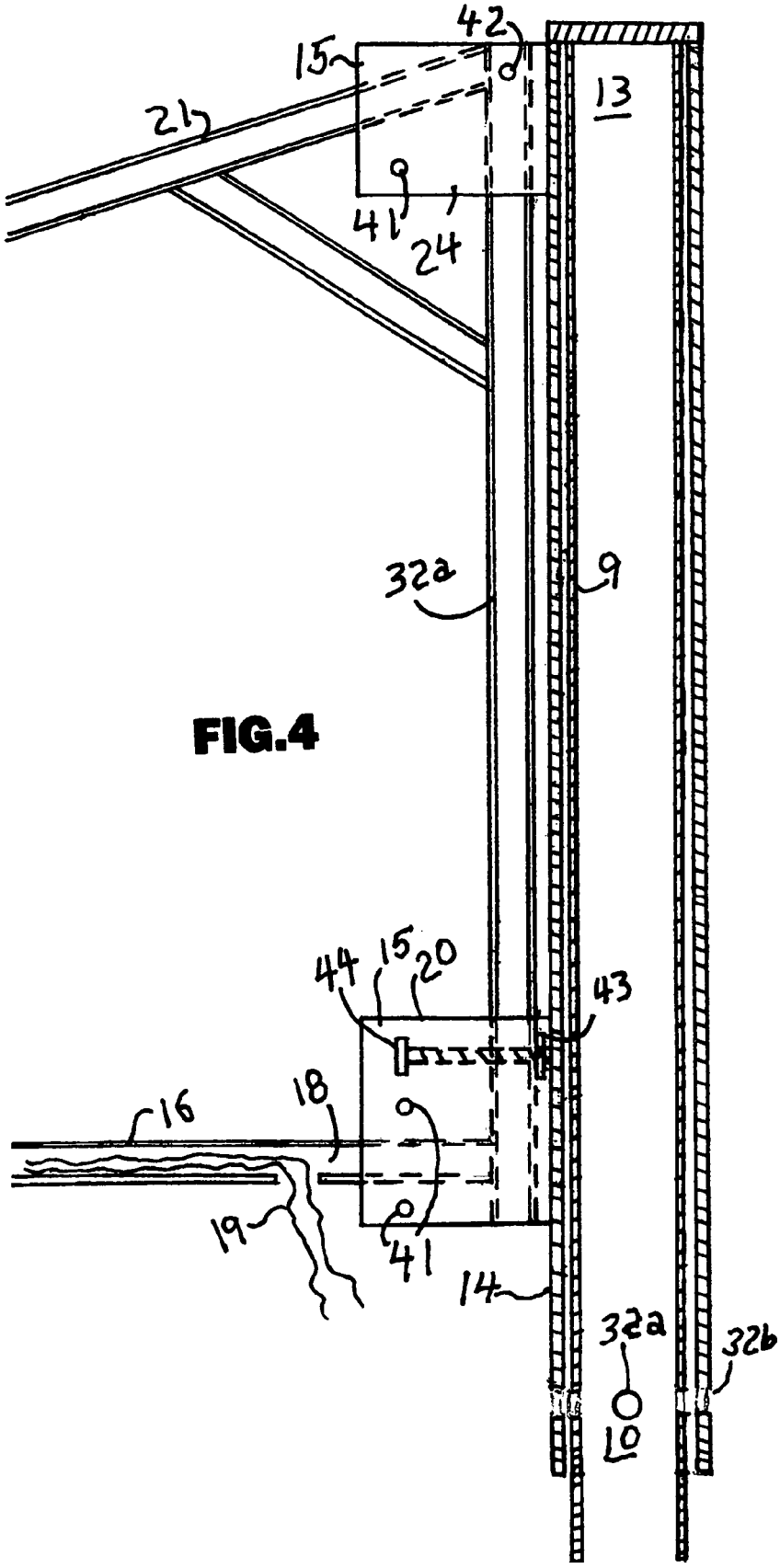
FIG. 4 is a sectional detail view through line 4-4 of FIG. 3.

The first attaching means 20 and second attaching means 24 in combination may provide means for fine adjustment of the extended position of the light fixture. In some situations, this is not provided or required. Each attaching means includes two parallel opposed plates 15 affixed to the sleeve that can clamp toward one another by bolts 41. As best seen in FIG. 4, upper attaching means 24 includes a pivot 42 fixed to the plates 15 and pivotally supporting the strut 32*a*. A threaded boss 43 is fixed to strut 32*a* at the lower attaching means 20. An adjusting bolt 44 passes through the strut and through boss 43. When the plates 15 of the attaching means are loosened, this bolt may be rotated to move the lower end of the bracket toward or from the sleeve, thereby moving the light fixture through an arc 31 as needed for fine positioning of the light. The bolts 41 may then be tightened to clamp the bracket securely in position.

Figure 5:
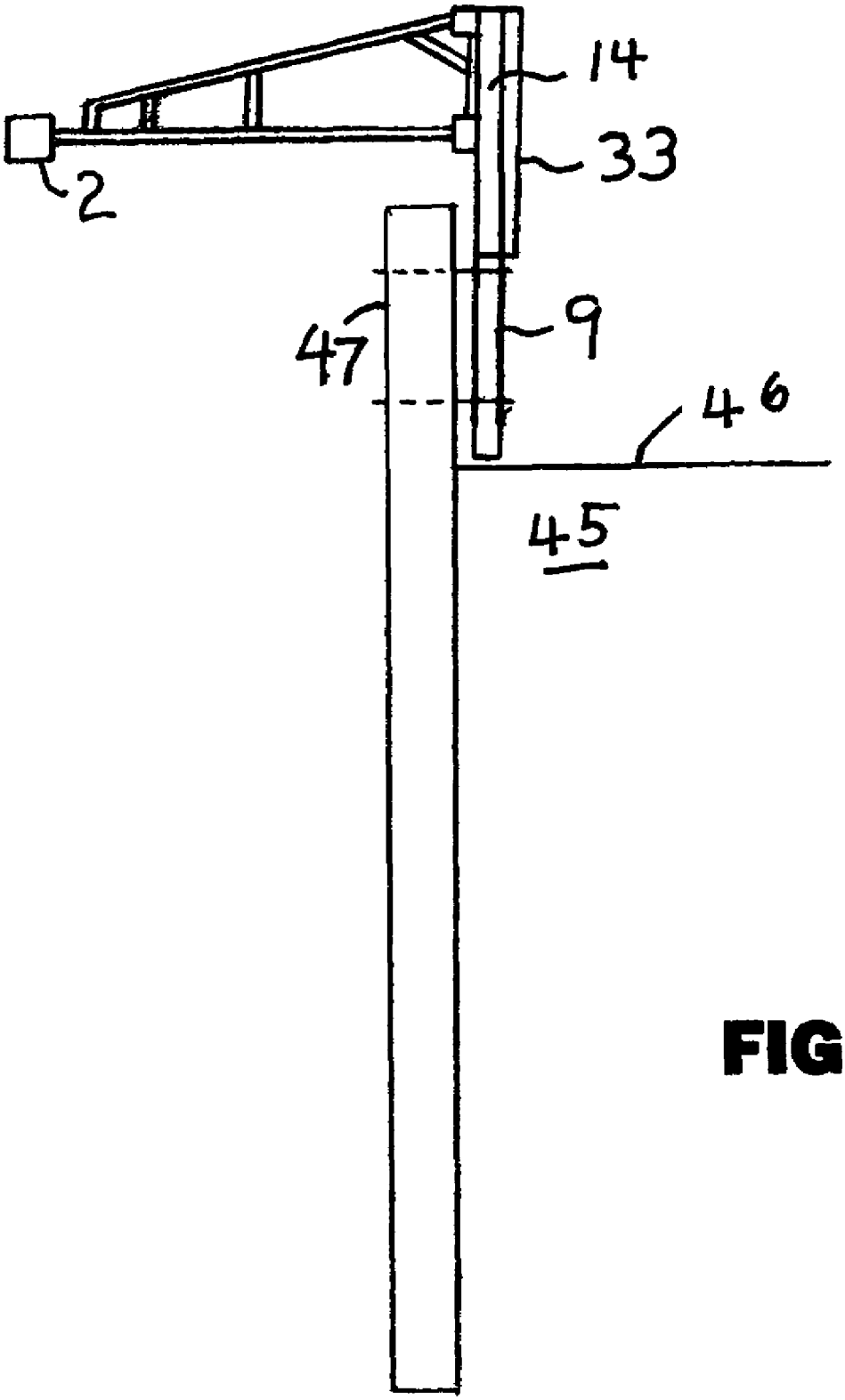
FIG. 5 is a side elevation view of a building with another embodiment of the invention in extended position.

Referring now to FIG. 5, another embodiment of the invention is shown in which the supporting structure is a building 45. The vertical cylinder 9 is affixed to the building parapet 47, and the worker standing on the roof 46 can access the light fixture 2 in the retracted position (not shown). In this embodiment, an elongate stiffening member 33 has been affixed to the sleeve 14 at a location diametrically opposed to the attaching means to overcome bending forces on the sleeve.

The invention may be applied to other supporting structures such as traffic signs, and the like. The invention is designed to facilitate the use of overhead illumination to help meet the demand for reduction of light pollution as announced by the Dark-Sky Association and others.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An overhead light swivel bracket assembly for mounting a light fixture spaced apart a fixed first distance and position from a surface to be illuminated, the surface mounted in a vertical plane on a rigid support structure, the structure including a walkway and an electric power conductor, the assembly comprising:

an elongate vertical cylinder having a lower end constructed for attaching to the structure and an upper end;

an elongate rigid capped sleeve dimensioned to be rotatably supported on the upper end of the cylinder;

an elongate tubular member having a distal end for affixing the light fixture thereto with an internal passage for electric wire for connecting the light fixture to the electric power conductor, and a proximal end attached by first attaching means to the sleeve;

an elongate element having a first end affixed to the distal end adjacent the light fixture and a second end attached by second attaching means to the sleeve above the first attaching means;

the capped sleeve, elongate tubular member, and elongate element combine to form a secure supporting bracket for the light fixture with rotational function to enable the capped sleeve and light fixture to rotate pivotally about the vertical cylinder in a horizontal arc between an extended position in which the light fixture is at the fixed first distance and position to illuminate the surface from above and a retracted position in which the light fixture is adjacent the walkway; and means for releasably preventing rotation of the sleeve between extended and retracted positions.

2. The assembly according to claim 1 in which the first and second attaching means are constructed for arcuate adjustment of the light fixture in the extended position.

3. The assembly according to claim 2 further comprising at least one stiffening strut connecting the tubular member to the elongate element.

4. The assembly according to claim 1 further comprising at least one stiffening strut connecting the tubular member to the elongate element.

5. An overhead light swivel bracket assembly for mounting a light fixture spaced apart a fixed first distance and position from a surface to be illuminated, the surface mounted in a vertical plane on a rigid support structure, the assembly comprising:

an elongate vertical cylinder having a lower end constructed for attaching to the structure and an upper end;

an elongate rigid capped sleeve dimensioned to be rotatably supported on the upper end of the cylinder;

an elongate tubular member having a distal end for affixing the light fixture thereto with an internal passage for electric wire for electrically connecting the light fixture to the electric power conductor, and a proximal end attached by first attaching means to the sleeve;

an elongate element having a first end affixed to the distal end adjacent the light fixture and a second end connected by second attaching means to the sleeve above the first attaching means;

at least one stiffening strut connecting the tubular member to the elongate element;

the capped sleeve, elongate tubular member, and elongate element combine to form a secure supporting bracket for the light fixture with rotational function to enable the capped sleeve and light fixture to rotate pivotally about the vertical cylinder in a horizontal arc between an extended position in which the light fixture is at the fixed first distance and position to illuminate the surface from above and a retracted position in which the light fixture is adjacent a worker positioned behind the plane; and means for releasably preventing rotation of the sleeve between extended and retracted positions.

6. The assembly according to claim 5 in which the first and second attaching means are constructed for arcuate adjustment of the light fixture in the extended position.

7. The assembly according to claim 5 further comprising an elongate stiffening member affixed to the sleeve at a location diametrically opposed to the attaching means.

8. An overhead light swivel bracket assembly for mounting a light fixture spaced apart a fixed first distance and position from a surface to be illuminated, the surface mounted in a vertical plane on a rigid support structure, the assembly comprising:

an elongate vertical cylinder having a lower end constructed for attaching to the structure and an upper end;

an elongate bracket having a distal end for affixing the light fixture thereto with an internal passage for electric wire for electrically connecting the light fixture to the electric power conductor, and a vertical capped sleeve at the proximal end constructed for rotation on the cylinder thereby enabling the light fixture to rotate pivotally about the vertical cylinder in a horizontal arc between an extended position in which the light fixture is at the fixed first distance and position to illuminate the surface from above and a retracted position in which the light fixture is adjacent a worker positioned behind the plane;

and means for releasably preventing rotation of the sleeve between extended and retracted positions.

* * * * *